US010252779B2

(12) United States Patent
Son et al.

(10) Patent No.: US 10,252,779 B2
(45) Date of Patent: Apr. 9, 2019

(54) UNMANNED VESSEL HAVING COUPLING APPARATUS AND RECOVERY METHOD THEREFOR

(71) Applicant: KOREA INSTITUTE OF OCEAN SCIENCE & TECHNOLOGY, Ansan-si, Gyeonggi-do (KR)

(72) Inventors: Nam Sun Son, Daejeon (KR); Sun Young Kim, Daejeon (KR); Yeon Gyu Kim, Daejeon (KR)

(73) Assignee: KOREA INSTITUTE OF OCEAN SCIENCE & TECHNOLOGY, Ansan-si, Gyeonggi-do (KR)

( * ) Notice: Subject to any disclaimer, the term of this patent is extended or adjusted under 35 U.S.C. 154(b) by 0 days.

(21) Appl. No.: 15/742,524

(22) PCT Filed: Jun. 27, 2016

(86) PCT No.: PCT/KR2016/006830
§ 371 (c)(1),
(2) Date: Jan. 8, 2018

(87) PCT Pub. No.: WO2017/007158
PCT Pub. Date: Jan. 12, 2017

(65) Prior Publication Data

US 2018/0201344 A1 Jul. 19, 2018

(30) Foreign Application Priority Data

Jul. 6, 2015 (KR) ..... 10-2015-0096076

(51) Int. Cl.
*B63B 21/16* (2006.01)
*B63B 21/66* (2006.01)
(Continued)

(52) U.S. Cl.
CPC ..... *B63B 21/16* (2013.01); *B63B 21/66* (2013.01); *B63B 27/10* (2013.01); *B63B 35/00* (2013.01);
(Continued)

(58) Field of Classification Search
CPC ..... B63B 21/16; B63B 27/10; B63B 35/00; B63B 21/66; F41F 5/04; F42B 12/00
(Continued)

(56) References Cited

U.S. PATENT DOCUMENTS 4,784,035 A * 11/1988 Fishfader ..... F41F 1/00 89/1.34

FOREIGN PATENT DOCUMENTS

JP 08-282578 A 10/1996
JP 2005-069660 A 3/2005
(Continued)

OTHER PUBLICATIONS

International Search Report for PCT/KR2016/006830 dated Sep. 30, 2016 from Korean Intellectual Property Office.

*Primary Examiner* — Lars A Olson
(74) *Attorney, Agent, or Firm* — Revolution IP, PLLC

(57) ABSTRACT

An unmanned vessel having a coupling apparatus includes: a heaving line launcher, which is provided on one side of the bow of the unmanned vessel; a coupling apparatus, which is provided at the center of gravity of the unmanned vessel and is coupled to a coupling member of a crane provided on a mother vessel; a first winch, which is provided on at least one side of either the bow or stern of the unmanned vessel, a first tow line being wounded around the same; and a second winch around which a second tow line, which passes one side of the coupling apparatus, is wound.

13 Claims, 5 Drawing Sheets

(51) Int. Cl.
*B63B 27/10* (2006.01)
*B63B 35/00* (2006.01)

(52) U.S. Cl.
CPC ..... *B63B 2035/006* (2013.01); *B63B 2708/00* (2013.01)

(58) Field of Classification Search
USPC ..... 114/254; 89/1.34
See application file for complete search history.

(56) References Cited

FOREIGN PATENT DOCUMENTS

| | | | |
|---|---|---|---|
| KR | 10-2010-0121089 | A | 11/2010 |
| KR | 10-2013-0047186 | A | 5/2013 |
| KR | 10-2013-0088404 | A | 8/2013 |

* cited by examiner

UNMANNED VESSEL HAVING COUPLING APPARATUS AND RECOVERY METHOD THEREFOR

BACKGROUND

The present invention relates to an unmanned vessel having a coupling apparatus and a method for recovering the same, and more particularly, to an unmanned vessel having a coupling apparatus which is easy to be coupled to a coupling member of a crane provided on a mother vessel or dock and is able to quickly and stably disposing and recovering an unmanned vessel into a position optimized for recovery through a first winch and a second winch, and a method for recovering the same.

Recently, Korea has experienced a high economic growth and a rapid growth and development of industry such as shipping, harbor, etc due to an increase of import and export trade volume using sea. Thus, the number of accidents at sea has been increased as vessels have become larger and faster in order to cope with the volume of trade suitable for economic scale.

The distress at sea caused by such an accident refers to various accidents that hinder the safe operation of a vessel carrying passenger or goods.

Generally, in the case of nearby sea, many measures are being sought to prevent the casualties in case of distress. However, in the case of distant sea excluding the nearby sea, it takes a lot of time to prevent the casualties. In addition, a lot of costs and time are required when the accident area is not known exactly in the case of lifting to identify the cause of the accident of the distress vessel as well as when the casualties in accident sea area is not known exactly.

In addition, when a large vessel is not easy to enter due to a reef or the like, there is a problem that an anchoring and a rescue operation may be further delayed.

In order to solve these problems, there have been developed a method for using an unmanned vessel in order to perform a quick and safe work, after disposing a relatively small unmanned vessel on a mother vessel such as a large-sized vessel or the like.

In order to recover the unmanned vessel into the mother vessel after the completion of the work, a crew uses a hook or other equipment to fasten a chain to an unmanned submersible, or the crew hangs a heaving line launched by the unmanned vessel to an electric winch to recover the unmanned vessel.

However, when a wind speed or a wave height is high, or when a flow velocity is high in a corresponding sea area, the accuracy of throwing a hook or the accuracy of the heaving line launched by the unmanned vessel may be reduced. Thus, sometimes, a coupling between the mother vessel and the unmanned vessel may not be smooth.

In addition, in order to recover the unmanned vessel through a crane provided on the mother vessel or the like, a wire coupled to the crane should be coupled to the unmanned vessel. However, since the unmanned vessel does not have a crew, the crew should move from the mother vessel to the unmanned vessel to couple both vessels using the wire, or a hook may be used to couple both vessels. However, there is a problem that such a work in sea is not easy. That is, there is a problem that the wire of the crane is not easily coupled, and a safety accident may occur when a crew moves to the unmanned vessel to couple the wire.

SUMMARY

The present invention has been made in view of the above problems, and provides an unmanned vessel having a coupling apparatus which is easy to be coupled to a coupling member of a crane provided on a mother vessel or dock and is able to quickly and stably disposing and recovering an unmanned vessel into a position optimized for recovery through a first winch and a second winch, and a method for recovering the same.

The object of the present invention is not limited thereto, and other objects not mentioned can be clearly understood by those skilled in the art from the following description.

In an aspect, there is provided an unmanned vessel having a coupling apparatus, the unmanned vessel including: a heaving line launcher which is provided on one side of a bow of the unmanned vessel; a coupling apparatus which is provided at a center of gravity of the unmanned vessel and is coupled to a coupling member of a crane provided on a mother vessel; a first winch, which is provided on at least one side of either the bow or a stern of the unmanned vessel, a first tow line being wounded around the same; and a second winch around which a second tow line, which passes one side of the coupling apparatus, is wound.

The heaving line launcher has a coupling apparatus which launches a heaving line to which ones side of the first tow line and the second tow line are concurrently coupled.

The coupling apparatus includes: a support unit which protrudes upwardly from one side of a deck of the unmanned vessel; a support plate provided on an upper surface of the support unit, the support plate having a through hole through which the second tow line penetrates; and a docking apparatus which is provided on one side of the support unit or the support plate.

The docking apparatus is a docking ring which is rotatably provided on one side of the support unit or the support plate.

An actuator which rotates the docking ring is provided at a rotation center of the docking ring.

The unmanned vessel further includes a sensor, which senses a coupling of the support plate and the coupling member, that is provided at one side of a contacting portion where a mutual contact occurs, in at least one of the support plate and the coupling member, wherein the actuator drives the docking ring by a signal of the sensor.

The coupling member includes: a coupling plate which corresponds to the support plate; and a fastening unit which is provided on one side of an upper surface of the coupling plate and has a shape corresponding to the docking apparatus so that the docking apparatus can be fastened, and has one side of an upper portion thereof connected to the crane.

One of the first winch and the second winch is directly driven by a motor and the other indirectly receives a rotational force of the motor to be rotatable.

In another aspect, there is provided a method of recovering an unmanned vessel having a coupling apparatus, the method including: a tow line launching step of launching a first tow line and a second tow line through a launcher provided on an unmanned vessel; a tow line coupling step of coupling the first tow line to one side of a mother vessel and coupling the second tow line to a coupling member of a crane provided on the mother vessel; an unmanned vessel towing step of towing the unmanned vessel by using the first tow line and the second tow line to a position where the coupling apparatus of the unmanned vessel and the coupling member of the crane correspond to each other; a coupling unit coupling step of coupling the coupling apparatus of the unmanned vessel with the coupling member of the crane; and an unmanned vessel recovery step of floating and recovering the unmanned vessel to the mother vessel by using the crane.

The tow line launching step includes launching a heaving line to which one sides of the first tow line and the second tow line are concurrently coupled.

The unmanned vessel towing step includes driving a first winch for winding the first tow line and a second winch for winding the second tow line to wind the first tow line and the second tow line, and lowering the crane to couple the coupling apparatus and the coupling member.

The unmanned vessel towing step includes towing the unmanned vessel as the second tow line penetrates through one side of the coupling apparatus and is fastened to the coupling member of the crane, and guiding the unmanned vessel to a position where the coupling member of the crane and the coupling apparatus correspond to each other.

The coupling unit coupling step includes: a coupling state checking step of checking a coupling state of the coupling apparatus and the coupling member; and a docking step of docking the coupling apparatus and the coupling member by driving a docking apparatus of the coupling apparatus when a coupling of the coupling apparatus and the coupling member is checked in the coupling state checking step.

An unmanned vessel having a coupling apparatus according to the present invention and a method for recovering the same have the following effects.

First, the unmanned vessel can be quickly and easily disposed to a position optimized for recovering the unmanned vessel by towing the unmanned vessel by using two tow lines of a first tow line and a second tow line.

Second, since the second tow line is provided to couple the coupling apparatus of the unmanned vessel and the coupling member of the crane for recovering the unmanned vessel, the coupling member of the crane can be coupled with the coupling apparatus of the unmanned vessel without a separate guide apparatus.

Third, the unmanned vessel can be more stably recovered through the rotational force of a second winch winding a second tow line and the double docking process of a docking apparatus of a coupling apparatus.

Fourth, when the unmanned vessel is shaken by waves, wind, or the like during the recovery of unmanned vessel, the tensile force of a first tow line can be controlled by operating a first winch for winding the first tow line, thereby restraining the unmanned vessel from being shaken, so that the unmanned vessel can be more stably recovered.

Fifth, since the crane and the unmanned vessel are automatically engaged, a crew does not need to directly couple the wire of the crane to the unmanned vessel, so that the safety accident can be prevented in advance.

The effects of the present invention are not limited to the effects mentioned above, and other effects not mentioned can be clearly understood by those skilled in the art from the description of the claims.

BRIEF DESCRIPTION OF THE DRAWINGS

The accompanying drawings incorporated herein illustrate preferred embodiments of the invention and, together with the description, serve to accomplish a further understanding of the technical concept of the invention, and should not be construed as being limited to the matters described in drawings.

DETAILED DESCRIPTION

Hereinafter, preferred embodiments of the present invention will be described with reference to the accompanying drawings.

Configuration of Unmanned Vessel Having Coupling Apparatus

Figure 1:
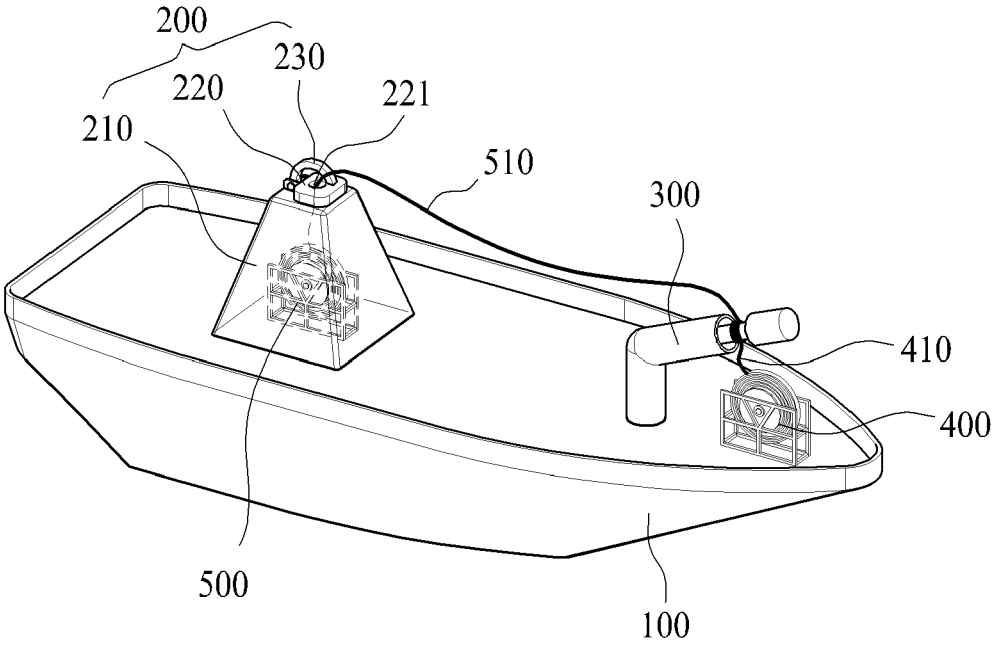
FIG. 1 is a perspective view of an unmanned vessel having a coupling apparatus according to the present invention.
Figure 2:
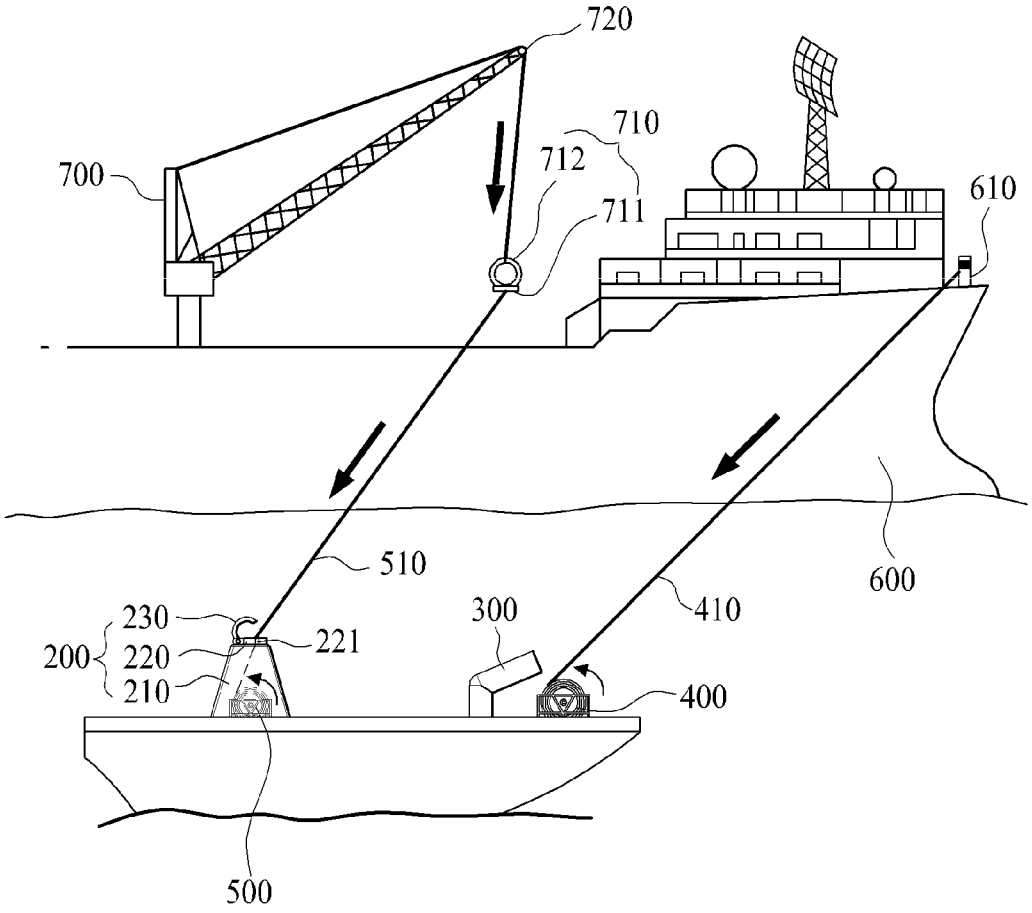
FIG. 2 is a side view showing a configuration for recovering an unmanned vessel having a coupling apparatus into a mother vessel according to the present invention.

FIG. 1 is a perspective view of an unmanned vessel having a coupling apparatus according to the present invention, and FIG. 2 is a side view showing a configuration for recovering an unmanned vessel having a coupling apparatus into a mother vessel 600 according to the present invention. An unmanned vessel 100 having the coupling apparatus according to the present invention may be implemented, as shown in FIG. 1, to easily recover, as shown in FIG. 2, the unmanned vessel 100 having the coupling apparatus. The unmanned vessel 100 may include a heaving line launcher 300, a coupling apparatus 200, a first winch 400, and a second winch 500. Each of these configurations will be described in more detail. In the present specification, it is illustrated as an embodiment that the unmanned vessel 100 is recovered into the mother vessel 600. The unmanned vessel 100 according to the present invention can be applied to any place such as a dock for recovering and storing the unmanned vessel 100 as well as the mother vessel 600.

The heaving line launcher 300 may be provided on one side of the unmanned vessel 100 to launch a heaving line for easily coupling a tow line for towing the unmanned vessel 100 to the mother vessel 600. Generally, since the tow line for towing the unmanned vessel 100 is rigidly manufactured in order to prevent breakage such as a snapping during the towing of the unmanned vessel 100, it may have a considerable weight. Since it is difficult to couple such a heavy tow line directly to the mother vessel 600, generally, a heaving line coupled to one end of the tow line is transmitted and a tow line coupled to the heaving line is received through the heaving line. As described above, the heaving line launcher 300 is an apparatus that connects a heaving line to a projectile such as a tow shell and launches it to a target point such as the mother vessel 600.

The heaving line launcher 300 is a cannon-type structure provided on one side of the unmanned vessel 100, preferably on one side of a deck, more preferably on one side of the bow of the deck. Although the heaving line launcher 300 may directly insert a heaving line into the inside of the heaving line launcher 300 to launch the heaving line, it is preferable to launch a shell such as a tow shell coupled with one end of the heaving line to improve the accuracy of transmission of the heaving line.

At this time, it is preferable that a first tow line 410 wound on the first winch 400 and a second tow line 510 wound on the second winch 500 are simultaneously coupled to the shell or the heaving line. The first tow line 410 and the second tow line 510 may be launched respectively. However, it is preferable that the first tow line 410 and the second tow line 510 are simultaneously coupled to the shell or the heaving line coupled to the shell in order to recover the unmanned vessel 100 quickly.

The coupling apparatus 200 may be provided on one side of the unmanned vessel 100, preferably on one side of the deck, more preferably on one side of the deck corresponding to the center of gravity of the unmanned vessel 100, and may have a shape corresponding to a coupling member 710 of the crane 700 provided in the mother vessel 600 or the dock to recover the unmanned vessel 100. That is, the coupling apparatus 200 is an apparatus for coupling the unmanned vessel 100 and the crane 700 so that the unmanned vessel 100 can be quickly and easily recovered through the crane 700. The configuration of the coupling apparatus 200 will be described in more detail.

Figure 3:
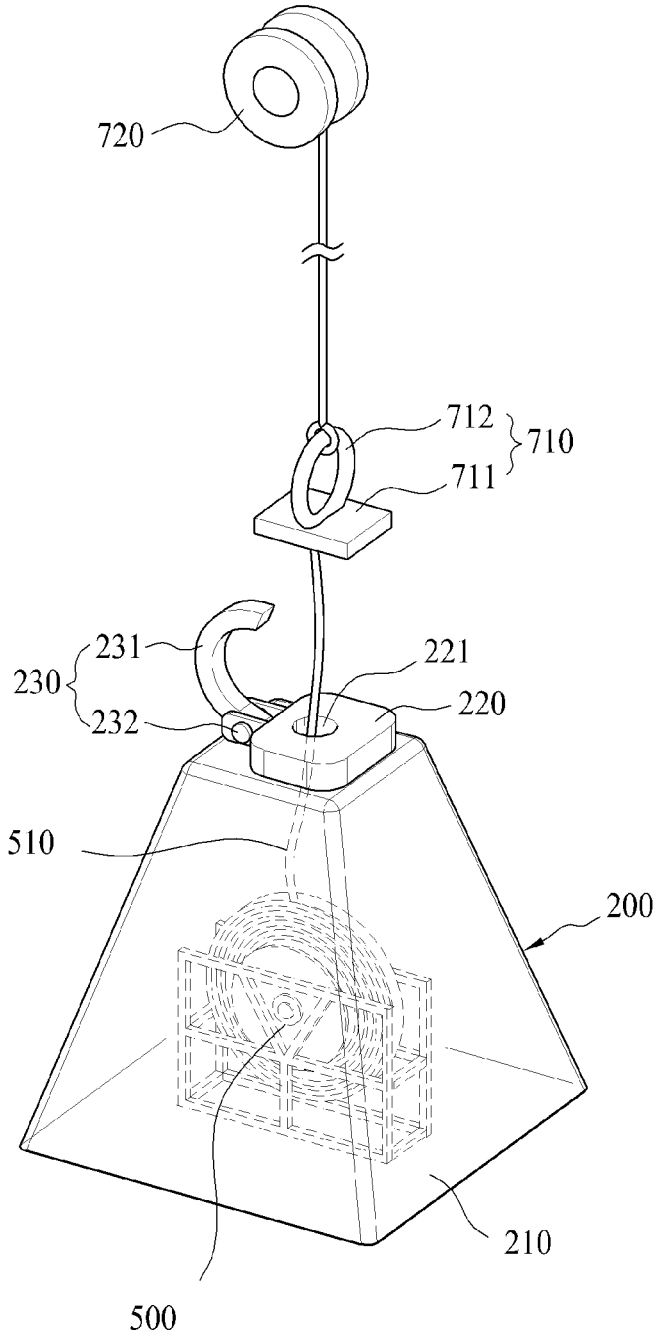
FIG. 3 is a perspective view showing a coupling apparatus and a state in which the coupling apparatus and a coupling member of a crane are coupled according to the present invention.
Figure 4:
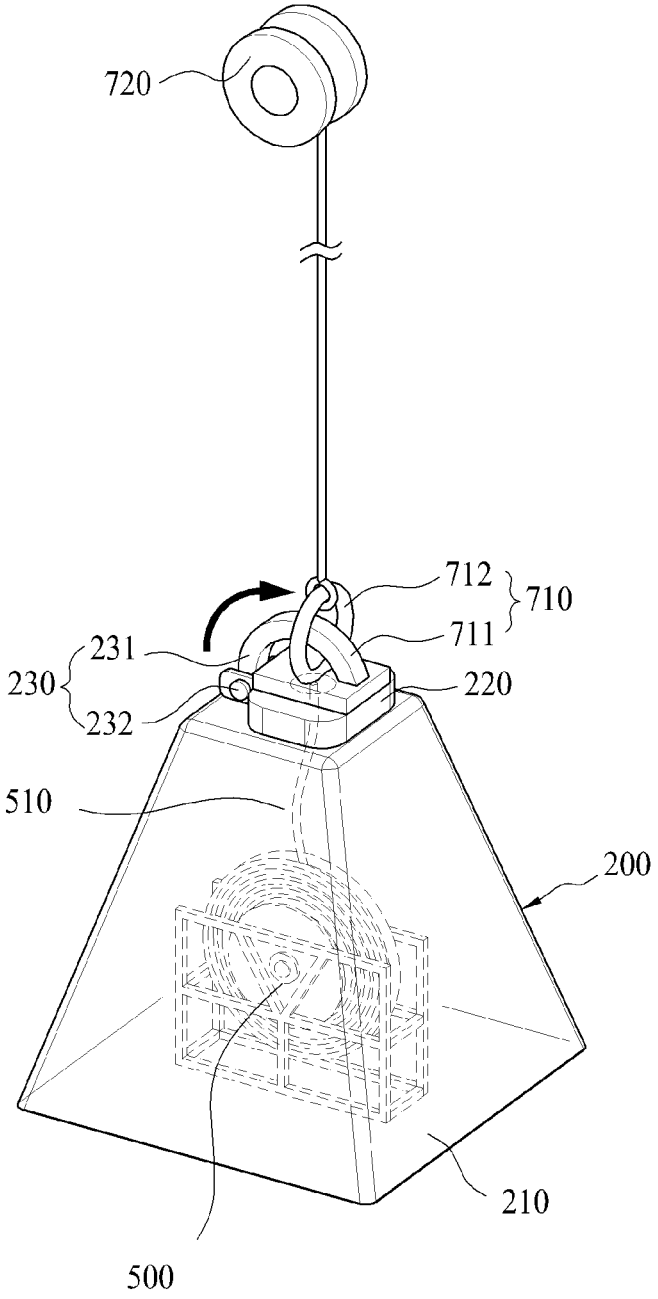
FIG. 4 is a perspective view showing a coupling apparatus and a state in which the coupling apparatus and a coupling member of a crane are coupled according to the present invention.

FIG. 3 is a perspective view showing a coupling apparatus and a state in which the coupling apparatus and a coupling member of a crane are coupled according to the present invention, and FIG. 4 is a perspective view showing a coupling apparatus and a state in which the coupling apparatus and a coupling member of a crane are coupled according to the present invention. As shown in FIGS. 1 to 4, the coupling apparatus 200 according to the present invention may include a support unit 210, a support plate 220, and a docking apparatus 230.

The support unit 210 may support the support plate 220 and the docking apparatus 230 that are substantially coupled with the coupling member 710 of the crane 700, and may fix the support plate 220 and the docking apparatus 230 stably at a certain height to be more easily coupled with the coupling member 710 of the crane 700. The support unit 210 may have any shape that can support the support plate 220 and the docking apparatus 230 at a certain height, but preferably may have a pillar shape. More preferably, the support unit 210 may be formed in a hollow shape so that the second winch 500 around which the second tow line 510 is wound can be provided therein, and a through hole through which the second tow line 510 can pass may be formed on one side of an upper surface.

The support plate 220 may be provided on the upper surface of the support unit 210 to firmly couple the coupling apparatus 200 and the coupling member 710 through a surface coupling with a coupling plate 711 of the coupling member 710. The support plate 220 may be formed of a separate member, but the upper surface of the support unit 210 may serve as the support plate. In addition, a through hole 221 through which the second tow line 510 penetrates may be formed on one side of the center of the support plate 220, and a sensor (not shown) for sensing the coupling with the coupling member 710 may be further provided on one surface facing the coupling plate 711 of the coupling member 710. The size of the support plate 220 may be selectively determined depending on an aspect of use so as to stably support the size and weight of the unmanned vessel 100, and the size of the support unit 210 may also be determined similarly.

The docking apparatus 230 is an apparatus which is provided on one side of the support unit 210 or the support plate 220 so that the coupling member 710 of the crane 700 can be brought into close contact with the support plate 220 to be stably fixed. That is, the docking apparatus 230 is an apparatus that firmly maintains a surface contact between the support plate 220 and the coupling plate 711 by pressing the support plate 220 and the coupling plate 711 so as to prevent the support plate 220 and the coupling plate 711 from being separated arbitrarily. The docking apparatus 230 may be any apparatus capable of achieving such a purpose. For example, a docking ring 231 driven by an actuator 232 may be used.

The docking ring 231 may be rotatably installed on one side of the support unit 210 or the support plate 220 so as to apply pressure from the upper portion to the lower portion. Such a docking ring 231 may be driven by user's handling, but it is preferable that the docking ring 231 is configured to be automatically driven by the actuator 232 as a crew does not embark in the unmanned vessel 100 typically.

The actuator 232 is an apparatus provided on one side of the docking ring 231 to provide power for driving the docking ring 231. The actuator 232 may be any apparatus that can rotate the docking ring 231 as necessary to press the support plate 220 and the coupling plate 711. A rotary actuator such as a motor that is provided at the center of rotation of the docking ring 231 to rotate the docking ring 231 is shown in the drawing. However, depending on an aspect of use, it is obvious that a linear actuator which provided at one side of the docking ring 231 to push or pull the docking ring 231 may be used. It is preferable that such an actuator 232 is controlled to be automatically driven in accordance with the sensing result of a sensor (not shown) provided at one side of the support plate 220. That is, when the sensor recognizes the coupling between the support plate 220 and the coupling plate 711, it is preferable that the docking ring 231 is automatically driven to press the support plate 220 and the coupling plate 711.

The configuration of the coupling member 710 of the crane 700 corresponding to the coupling apparatus 200 formed as described above will be described in more detail.

The coupling member 710 of the crane 700 may quickly and easily couple the wire of the crane 700 with the coupling apparatus 200 of the unmanned vessel 100 in order to recover the unmanned vessel 100 through the crane 700, and may have a shape corresponding to the coupling apparatus 200 of the unmanned vessel 100. Such a coupling member 710 may mainly include the coupling plate 711 and a fastening unit 712.

The coupling plate 711 may be formed of a flat plate member corresponding to the support plate 220 of the coupling apparatus 200, and a fastening ring (not shown) for fastening the second tow line 510 formed on one side corresponding to the through hole 221 formed in the support plate 220 may be formed at one side of the lower surface of the coupling plate 711, preferably at one side of the center of the lower surface. Since the second tow line 510 passes through the through hole 221 of the support plate 220 and is fastened to the lower surface of the coupling plate 711, when the second tow line 510 is wound, the coupling plate 711 may be easily coupled with the support plate 220. In the above-described configuration, a sensor may be formed on one side of the support plate 220, but it may be provided on one side of the lower surface of the coupling plate 711, depending on an aspect of use.

In addition, an insertion groove (not shown) into which one end of the docking ring 231 can be inserted may be formed at one side of the coupling plate 711. In the case where such an insertion groove is formed, one end of the docking ring 231 may be inserted into the insertion groove, thereby more easily preventing the docking ring 231 from being detached arbitrarily.

The fastening unit 712 is an apparatus which is provided at one side of the upper portion of the coupling plate 711 so as to be coupled to the wire of the crane 700 and prevents the docking ring 231 from being separated arbitrarily. The fastening unit 712 may have any shape, but preferably may have a ring shape to form a closed loop as the wire of the crane 700 should be coupled. In addition, when it is formed of the ring shape, the docking ring 231 may smoothly pass through the fastening unit 712, so that the coupling plate 711 can be easily pressed to the support plate 220.

The first winch 400 is an apparatus that wind the first tow line 410, and it is preferable that a winch that is commonly used in the art is used as the first winch 400. It is preferable that the first winch 400 is provided on one side of the bow or stern of the unmanned vessel 100 so that the unmanned vessel 100 can be easily towed when the unmanned vessel 100 is recovered. It is more preferable that the first winch 400 is provided on one side of the bow of the unmanned vessel 100.

The second winch 500 is an apparatus that wind the second tow line 510, and it is preferable that a winch that is commonly used in the art is used as the second winch 500, like the first winch 400. It is preferable that this second winch 500 is inserted into one side of the center of gravity of the unmanned vessel 100, more preferably, into the inside of the support unit 210 of the coupling apparatus 200

The first winch 400 and the second winch 500 may be configured to have an independent power transmission means capable of winding and releasing the first and second tow lines 410 and 510 respectively by rotating and counter-rotating the winch respectively. However, depending on an aspect of use, only one of the first winch 400 and the second winch 500 may be provided with a power transmission means, and the other may receive a power transmitted through a belt or the like so that both of the first winch 400 and the second winch 500 can be driven simultaneously.

Recovery Method of Unmanned Vessel Having Coupling Apparatus

A method for recovering the unmanned vessel 100 having the coupling apparatus of the above-described configuration from the mother vessel 600 or the dock is described in detail. In the present invention, it is mainly described that the unmanned vessel 100 is recovered to the mother vessel 600. However, depending on an aspect of use, it is obvious that the unmanned vessel 100 can be recovered to the land such as a dock, not to the mother vessel 600.

Figure 5:
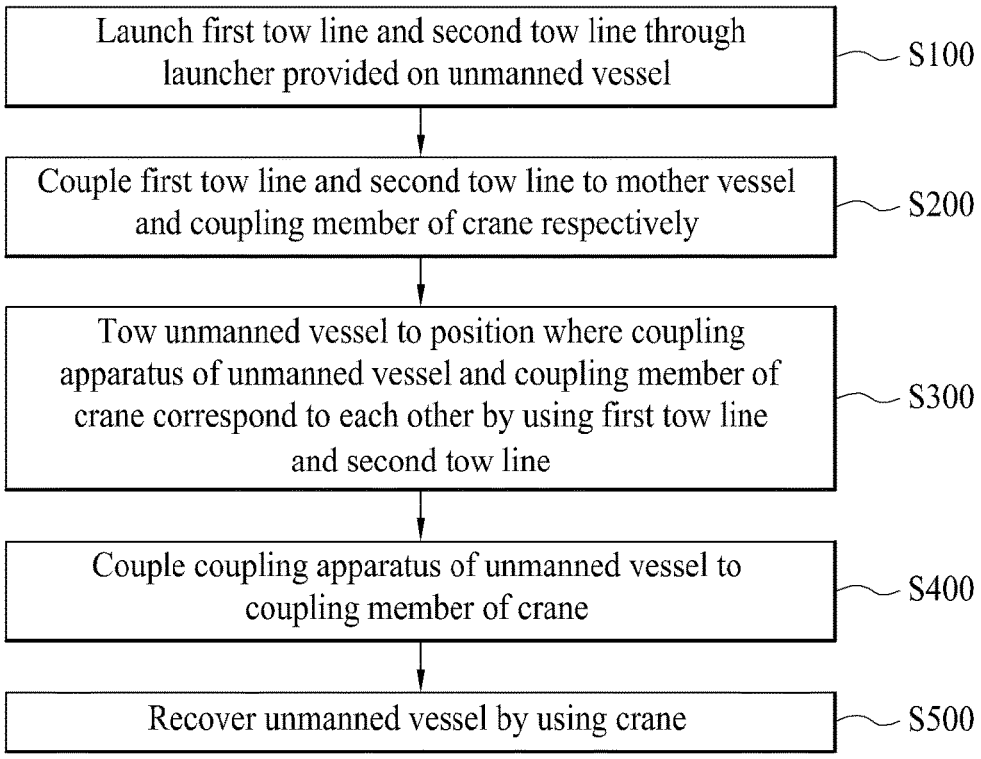
FIG. 5 is a flowchart sequentially showing a method for recovering an unmanned vessel having a coupling apparatus according to the present invention.

FIG. 5 is a flowchart sequentially showing a method for recovering an unmanned vessel having a coupling apparatus according to the present invention. The first tow line 410 and the second tow line 510 may be launched through the launcher 300 provided on the unmanned vessel 100 so that the first tow line 410 and the second tow line 510 can be transmitted to the mother vessel 600 respectively (S100). At this time, the first tow line 410 and the second tow line 510 may be sequentially launched through the launcher 300. However, in order to more easily launch the first tow line 410 and the second tow line 510 to the mother vessel 600, it is preferable that the first tow line 410 and the second tow line 510 are transmitted to the mother vessel 600 at one time in the state in which one end portion of the first tow line 410 and the second tow line 510 are connected to a projectile such as a tow shell launched by the launcher 300 or a heaving line connected to the projectile.

Next, the first tow line 410 and the second tow line 510 may be coupled to one side of the mother vessel 600 and the crane 700, respectively (S200). The first tow line 410 may serve to tow the unmanned vessel 100 to a position that is optimized for the recovery, i.e., in a direction perpendicular to the wire descending from a pulley 720 of the crane 700. The first tow line 410 may be coupled to a towing boom 610 and the like provided on one side of the mother vessel 600.

The second tow line 510 may serve to couple the coupling member 710 coupled to the wire of the crane 700 to the coupling apparatus 200 of the unmanned vessel 100 smoothly. The second tow line 510 may be coupled to one side of the coupling member 710 of the crane 700.

Next, by using the first tow line 410 and the second tow line 510, the unmanned vessel 100 may be towed to an optimum position for the recovery of unmanned vessel 100 where the coupling apparatus 200 of the unmanned vessel 100 and the coupling member 710 of the crane 700 correspond to each other (S300). As shown in FIG. 2, the first tow line 410 coupled to the towing boom 610 of the mother vessel 600 may be wound to tow the unmanned vessel 100 by driving the first winch 400, and, simultaneously, as shown in FIGS. 3 and 4, the second tow line 510 coupled to the coupling member 710 of the crane 700 may be wound by driving the second winch 500. At this time, the wire of the crane 700 may be operated so that the second tow line 510 can be wound in a state of being kept as tight as possible by extending the wire of the crane 700 as much as the second tow line 510 is wound. Thus, the unmanned vessel 100 may be disposed at a position optimized for recovery through the first tow line 410, and concurrently, the coupling member 710 of the crane 700 may be guided through the second tow line 510. Accordingly, the coupling member 710 of the crane 700 may be quickly and stably guided to a position corresponding to the coupling apparatus 200 without a separate coupling guide apparatus.

Figure 6:
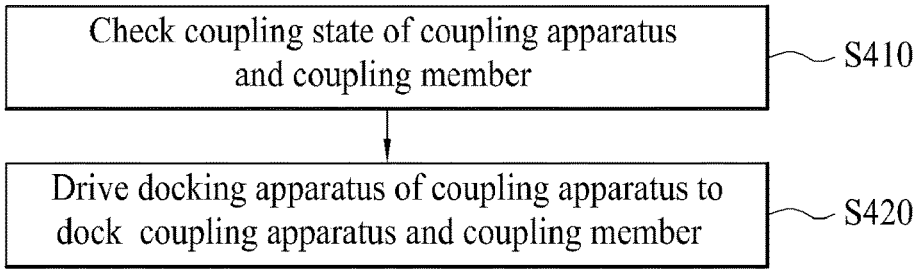
FIG. 6 is a flowchart showing in more detail a coupling step of a coupling unit according to the present invention.

FIG. 6 is a flowchart showing in more detail a coupling step of a coupling unit according to the present invention. The coupling apparatus 200 of the unmanned vessel 100 may be coupled to the coupling member 710 of the crane 700 (S400). The coupling step S400 of coupling unit will be described in more detail.

First, the coupling state of the coupling apparatus 200 and the coupling member 710 may be checked (S410). That is, it is checked whether the support plate 220 and the coupling plate 711 are tightly coupled through a sensor (not shown) provided on one side of the support plate 220 or the coupling plate 711. At this time, when no signal is input to the sensor, the second tow line 510 may be further wound to make the support plate 220 and the coupling plate 711 to be adhered so that the support plate 220 and the coupling plate 711 can be adhered as much as possible.

Then, when the sensor (not shown) determines that the support plate 220 and the coupling plate 711 are closely coupled to each other at the above step, as shown in FIG. 4, the docking apparatus 230 may be driven so that the coupling apparatus 200 and the coupling member 710 may be docked so as not to be separated from each other arbitrarily (S420). That is, the actuator 232 may be driven to allow the docking ring 231 to press the coupling plate 711 downwardly from the top so that the coupling plate 711 may be supported so as not to be separated from the support plate 220.

Finally, the wire coupled to the coupling member 710 of the crane 700 may be wound and the unmanned vessel 100 may be recovered (S500). At this time, the second winch 500 may fix the second tow line 510 so as not to be loosened, or provide a certain power in the direction in which the second tow line 510 is wound, so that the coupling member 710 can be more stably coupled to the coupling apparatus 200 when the unmanned wire 100 is recovered. Even if the coupling apparatus 200 is positioned at the center of gravity of the unmanned vessel 100, when the unmanned vessel 100 is shaken due to the surrounding environment such as wind, waves, or the like, the tensile force of the first tow line 410 may be controlled through the first winch 400 to keep the unmanned vessel 100's balance so that the unmanned vessel 100 can be more stably recovered.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. An unmanned vessel having a coupling apparatus comprises:

a heaving line launcher which is provided on one side of a bow of the unmanned vessel;

a coupling apparatus which is provided at a center of gravity of the unmanned vessel and is coupled to a coupling member of a crane provided on a mother vessel;

a first winch, which is provided on at least one side of either the bow or a stern of the unmanned vessel, a first tow line being wounded around the same; and a second winch around which a second tow line, which passes one side of the coupling apparatus, is wound.

2. The unmanned vessel of claim 1, wherein the heaving line launcher has a coupling apparatus which launches a heaving line to which ones side of the first tow line and the second tow line are concurrently coupled.

3. The unmanned vessel of claim 1, wherein the coupling apparatus comprises:

a support unit which protrudes upwardly from one side of a deck of the unmanned vessel;

a support plate provided on an upper surface of the support unit, the support plate having a through hole through which the second tow line penetrates; and a docking apparatus which is provided on one side of the support unit or the support plate.

4. The unmanned vessel of claim 3, wherein the docking apparatus is a docking ring which is rotatably provided on one side of the support unit or the support plate.

5. The unmanned vessel of claim 4, wherein an actuator which rotates the docking ring is provided at a rotation center of the docking ring.

6. The unmanned vessel of claim 4, further comprising a sensor, which senses a coupling of the support plate and the coupling member, that is provided at one side of a contacting portion where a mutual contact occurs, in at least one of the support plate and the coupling member, wherein the actuator drives the docking ring by a signal of the sensor.

7. The unmanned vessel of claim 3, wherein the coupling member comprises:

a coupling plate which corresponds to the support plate; and a fastening unit which is provided on one side of an upper surface of the coupling plate and has a shape corresponding to the docking apparatus so that the docking apparatus can be fastened, and has one side of an upper portion thereof connected to the crane.

8. The unmanned vessel of claim 1, wherein one of the first winch and the second winch is directly driven by a motor and the other indirectly receives a rotational force of the motor to be rotatable.

9. A method of recovering an unmanned vessel having a coupling apparatus, the method comprises:

a tow line launching step of launching a first tow line and a second tow line through a launcher provided on an unmanned vessel;

a tow line coupling step of coupling the first tow line to one side of a mother vessel and coupling the second tow line to a coupling member of a crane provided on the mother vessel;

an unmanned vessel towing step of towing the unmanned vessel by using the first tow line and the second tow line to a position where the coupling apparatus of the unmanned vessel and the coupling member of the crane correspond to each other;

a coupling unit coupling step of coupling the coupling apparatus of the unmanned vessel with the coupling member of the crane; and an unmanned vessel recovery step of floating and recovering the unmanned vessel to the mother vessel by using the crane.

10. The method of claim 9, wherein the tow line launching step comprises launching a heaving line to which one sides of the first tow line and the second tow line are concurrently coupled.

11. The method of claim 9, wherein the unmanned vessel towing step comprises driving a first winch for winding the first tow line and a second winch for winding the second tow line to wind the first tow line and the second tow line, and lowering the crane to couple the coupling apparatus and the coupling member.

12. The method of claim 9, wherein the unmanned vessel towing step comprises towing the unmanned vessel as the second tow line penetrates through one side of the coupling apparatus and is fastened to the coupling member of the crane, and guiding the unmanned vessel to a position where the coupling member of the crane and the coupling apparatus correspond to each other.

13. The method of claim 9, wherein the coupling unit coupling step comprises:

a coupling state checking step of checking a coupling state of the coupling apparatus and the coupling member; and a docking step of docking the coupling apparatus and the coupling member by driving a docking apparatus of the coupling apparatus when a coupling of the coupling apparatus and the coupling member is checked in the coupling state checking step.

* * * * *